US007823733B2

(12) United States Patent
Futori

(10) Patent No.: US 7,823,733 B2
(45) Date of Patent: Nov. 2, 2010

(54) ARTICLE DISPLAY TRAY PROVIDED WITH MOVEMENT GUIDE DEVICE, AND MOVEMENT GUIDE DEVICE

(75) Inventor: Minoru Futori, Tokyo (JP)

(73) Assignee: System Communications, Inc., Tokyo (JP)

( * ) Notice: Subject to any disclaimer, the term of this patent is extended or adjusted under 35 U.S.C. 154(b) by 87 days.

(21) Appl. No.: 12/294,286

(22) PCT Filed: Jun. 16, 2006

(86) PCT No.: PCT/JP2006/312093

§ 371 (c)(1),
(2), (4) Date: Sep. 24, 2008

(87) PCT Pub. No.: WO2007/116536

PCT Pub. Date: Oct. 18, 2007

(65) Prior Publication Data

US 2009/0090684 A1 Apr. 9, 2009

(30) Foreign Application Priority Data

Mar. 31, 2006 (JP) ..... 2006-099037

(51) Int. Cl.
*A47F 7/00* (2006.01)

(52) U.S. Cl. ..... 211/59.2; 211/74; 211/49.1; 221/208; 221/261; 221/67; 312/72

(58) Field of Classification Search ..... 211/59.2, 211/59.3, 74, 49.1; 221/22, 67, 208, 261; 193/25 FT, 28, 31 A, 32; 312/61, 71, 72
See application file for complete search history.

(56) References Cited

U.S. PATENT DOCUMENTS 2,029,263 A * 1/1936 Keighley ..... 62/378
2,581,363 A * 1/1952 Creedon ..... 211/134

(Continued)

FOREIGN PATENT DOCUMENTS

DE 19803985 8/1999

(Continued)

OTHER PUBLICATIONS

English language Abstract of JP 2002-142925, May 21, 2002.

*Primary Examiner*—Darnell M Jayne
*Assistant Examiner*—Patrick Hawn
(74) *Attorney, Agent, or Firm*—Greenblum & Bernstein P.L.C.

(57) ABSTRACT

An article display tray is provided with a movement guide device, wherein cylindrical articles can move more smoothly in a communication portion of the article display tray, via which the pair of storage chambers are communicatively connected to each other, and further wherein an increase in size of the article display tray can be avoided. A pair of left-right force-applied portions and an arraying guide surface positioned between the pair of force-applied portions are formed on a rocking member positioned inside the rear-end communication portion of an article display tray. When one of the pair of force-applied portions is pushed rearward by a cylindrical article that is placed in one of a pair of left-right storage chambers, the other force-applied portion pushes forward a cylindrical article that is placed in the other storage chamber. When the aforementioned one cylindrical article that pushes the aforementioned one force-applied portion rearward comes into engagement with the arraying guide surface after pushing the aforementioned one force-applied portion rearward, the arraying guide surface returns the rocking member to a neutral position where the pair of left-right storage rooms are aligned in a leftward/rightward direction.

10 Claims, 15 Drawing Sheets

U.S. PATENT DOCUMENTS

| | | | | | |
|---|---|---|---|---|---|
| 2,678,735 | A | * | 5/1954 | Crcedon | 211/74 |
| 3,072,405 | A | * | 1/1963 | Bauerschmidt | 473/88 |
| 3,146,907 | A | * | 9/1964 | Bookout | 221/67 |
| 3,501,016 | A | * | 3/1970 | Eaton | 211/49.1 |
| 4,228,996 | A | * | 10/1980 | Wilcox, Jr. | 271/297 |
| 5,511,688 | A | * | 4/1996 | Duncan et al. | 221/67 |
| 5,865,324 | A | * | 2/1999 | Jay et al. | 211/59.2 |
| 6,502,408 | B1 | | 1/2003 | Corcoran | |

FOREIGN PATENT DOCUMENTS

| | | |
|---|---|---|
| JP | 62-120855 | 7/1987 |
| JP | 2002-142925 | 5/2002 |

* cited by examiner

ARTICLE DISPLAY TRAY PROVIDED WITH MOVEMENT GUIDE DEVICE, AND MOVEMENT GUIDE DEVICE

FIELD OF THE INVENTION

The present invention relates a display tray, equipped with a movement guide device, for displaying articles, commodities or goods which are cylindrical in cross section (e.g., cans or bottles), and further relates to a movement guide device.

BACKGROUND OF THE INVENTION

In an open-case type display tray for displaying cylindrical articles such as cans or bottles, the display tray is restocked with articles from the open front of the display tray because of its structure. Meanwhile, the seller has a demand for reliably selling articles in the lot first restocked (known as FIFO (first in, first out)), i.e., old articles, in consideration of the best-before date (sell-by date) and the impression of consumers. However, in an open-case type display tray, which is restocked with articles from the open front of the display tray, the already-restocked and displayed articles are pushed into the back of the display tray if the display tray is restocked with new articles, so that the earlier articles are restocked, the later they will be sold; a phenomenon known as FILO (first in, last out) occurs. In addition, if FILO is done in chilled (refrigerated) articles, a problem arises with well-chilled articles that are displayed for a long time sitting at the back of the display tray, whereas not-yet-chilled articles that are not yet chilled because they have just been restocked remain at the front of the display tray. To resolve this kind of problem, each time the display tray is restocked with articles, it is necessary to take time to move the already-restocked articles to the front of the display tray and move new articles into the rear of the display tray, which is an inefficient operation.

Under these circumstances, the applicant of the present invention has invented a display tray for displaying cylindrical articles which are placed at a front-back direction for display. The display tray includes a pair of laterally-arranged parallel storage chambers. The pair of storage chambers have article mount surfaces for supporting bottom surfaces of the cylindrical articles, and straight guiding surfaces for shiftably guiding each of the cylindrical articles in the front-back direction. The front and rear ends of the pair of storage chambers are communicatively connected to each other via a communication portion of the display tray to allow the cylindrical articles to move from one to the other of the pair of storage chambers via the communication portion (Japanese Unexamined Patent Publication 2002-142925; herein referred as Patent Document 1).

However, there is still room for improvement in the article display tray disclosed in Patent Document 1 to smooth movements of the cylindrical articles in the communication portion on the rear end side of the article display tray.

Accordingly, it is an object of the present invention to provide an article display tray provided with a movement guide device, and a movement guide device, wherein cylindrical articles can move more smoothly in a communication portion of the article display tray, via which the pair of storage chambers are communicatively connected to each other, and further wherein an increase in size of the article display tray can be avoided.

DISCLOSURE OF THE INVENTION

An article display tray with a movement guide device according to the present invention is characterized in that the article display tray includes: an article display tray including a pair of left-right storage chambers and a rear-end communication portion which communicatively connects rear end portions of the pair of left-right storage chambers to each other, cylindrical articles that are circular in cross section being movable between the pair of left-right storage chambers through the rear-end communication portion; and a rocking member positioned inside the rear-end communication portion of the article display tray and capable of rocking about a rocking shaft extending in a vertical direction; wherein the rocking member includes a pair of force-applied portions which are positioned at left and right ends of the rocking member on extension lines of the pair of left-right storage chambers, respectively, and an arraying guide surface positioned between the pair of force-applied portions; wherein, when one of the pair of force-applied portions is pushed rearward by one of the cylindrical articles which is placed in one of the pair of left-right storage chambers, and the other of the pair of force-applied portions pushes another of the cylindrical articles forward which is placed in the other of the pair of left-right storage chambers; and wherein, upon the one of the cylindrical articles pushing the one of the force-applied portions rearward so as to come into engagement with the arraying guide surface after pushing the one of the pair of force-applied portions rearward, the arraying guide surface returns the rocking member to a neutral position where the pair of left-right storage chambers are aligned in a leftward/rightward direction.

It is desirable for the article display tray or the movement guide device to include a guide surface for moving one of the cylindrical articles which engages with the arraying guide surface to a position immediately before the one of the force-applied portions which is positioned ahead of the one of the cylindrical articles in a direction of movement thereof when the one of the cylindrical articles that engages with the arraying guide surface is pushed rearward by one of the cylindrical articles which is positioned at the rear end portion of the one of the pair of storage chambers.

It is desirable that at least one of the pair of force-applied portions is a curved surface.

It is desirable for guide grooves narrower in width than diameters of the cylindrical articles to be formed on an article mount surface of the article display tray along a direction of movement of the cylindrical articles, the article mount surface supporting bottom surfaces of the cylindrical articles placed in the pair of storage chambers.

In addition, a movement guide device which is installed at a rear-end communication portion of the article display tray according to the present invention is characterized in that the movement guide device includes: a pair of left-right storage chambers and the rear-end communication portion which communicatively connects rear end portions of the pair of left-right storage chambers to each other, cylindrical articles that are circular in cross section being movable between the pair of left-right storage chambers through the rear-end communication portion, wherein the movement guide device includes: a rocking member capable of rocking about a rocking shaft extending in a vertical direction; a pair of force-applied portions provided at left and right ends of the rocking member and positioned on extension lines of the pair of left-right storage chambers, respectively; and an arraying guide surface formed between the pair of force-applied portions. When one of the pair of force-applied portions is pushed rearward by one of the cylindrical articles which is placed in one of the pair of left-right storage chambers, and the other of the pair of force-applied portions pushes another of the cylindrical articles forward which is placed in the other of the pair of left-right storage chambers. Upon the one of the cylindrical articles pushing the one of the force-applied portions rearward so as to come into engagement with the arraying guide surface, the arraying guide surface returns the rocking member to a neutral position where the pair of left-right storage chambers are aligned in a leftward/rightward direction.

EMBODIMENTS

Firstly, the first embodiment will be hereinafter discussed with reference to FIGS. 1 through 11. Note that the forward/rearward direction and the leftward/rightward direction in the following descriptions shall be the directions shown by the arrows shown in FIG. 1.

Figure 5:
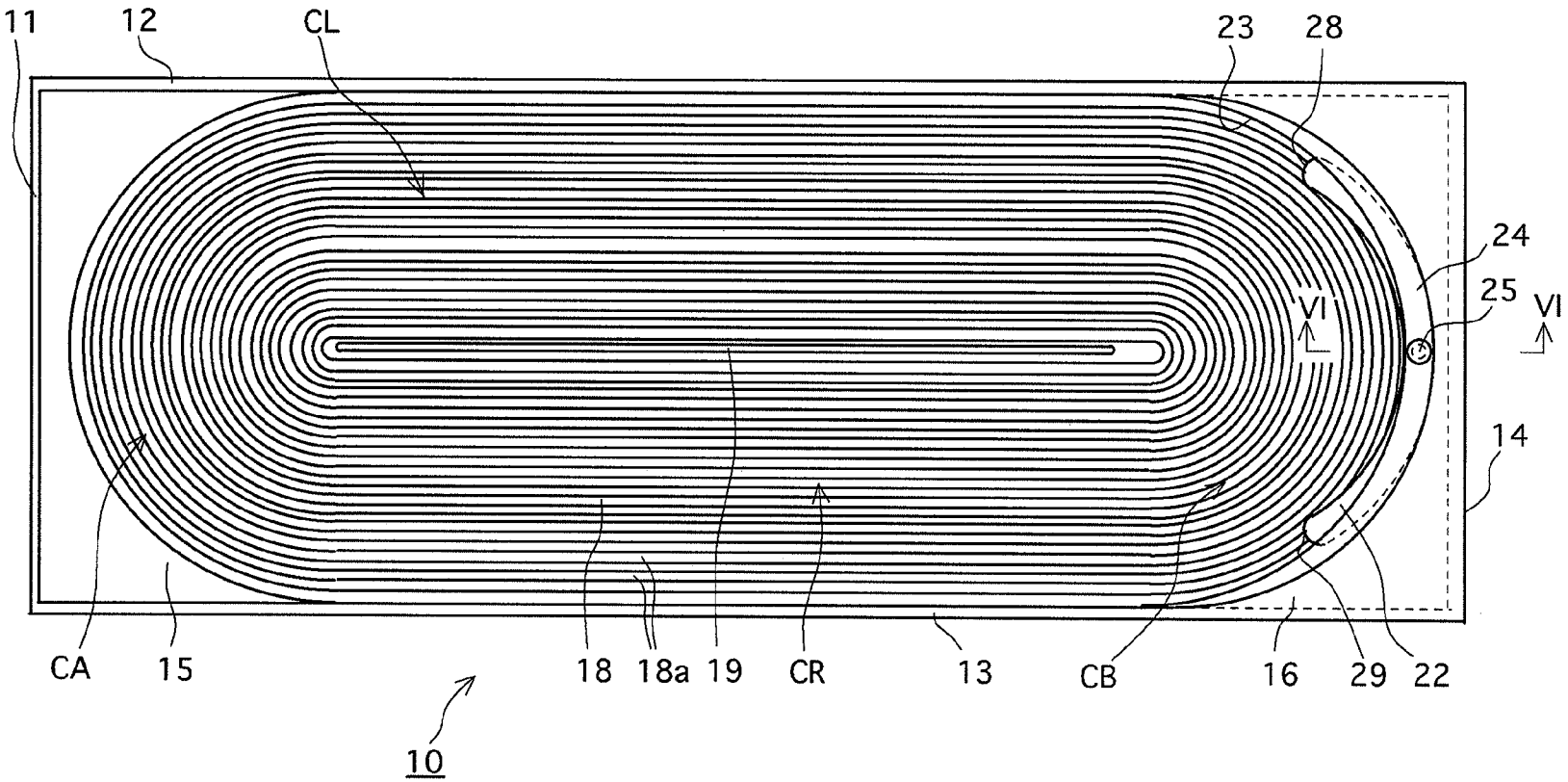
FIG. 5 is a plan view of the article display tray.
Figure 6:
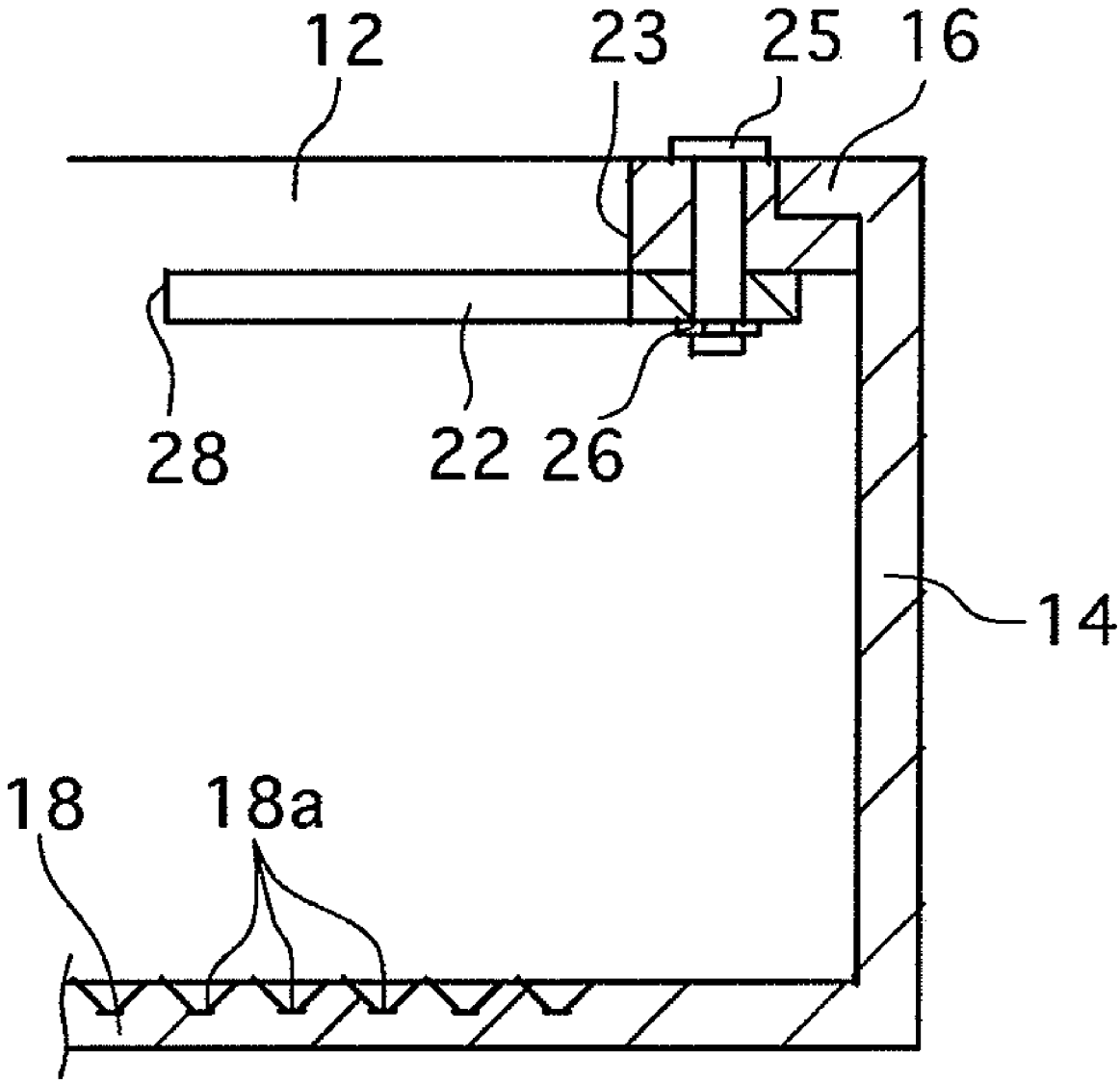
FIG. 6 is a cross sectional view taken along the VI-VI line shown in FIG. 5.

A box-shaped article display tray 10 having an opening at the top is, e.g., fixed to the inside of a refrigeration case, not shown in the drawings, and is integrally provided with a front plate 11, a left-side plate 12, a right-side plate 13, a rear plate 14, a bottom plate 15, and a rear top plate 16, the front surface of which is in the shape of a substantially circular arc. The rear end of the bottom plate 15 is in the shape of a semicircle, and a gap 17 is formed between the rear end portion of the bottom plate 15 and the bottom end portion of the rear plate 14. The bottom plate 15 is further provided with an article mount surface 18 which is shaped like a rectangle, at which two semicircles are formed at the front and rear ends thereof, respectively (similar to a running track). The article mount surface 18 is a portion of the article display tray 10 on which cans W0 through W8, constituting cylindrical articles which are circular in cross section, are mounted. As shown in FIGS. 5 and 6, the article mount surface 18 is provided with a large number of guide grooves 18*a* which are similar in shape to the contour of the article mount surface 18. Each of the guide grooves 18*a* is a bottomed groove narrower in width than the diameters of the cans W0 through W8, and is for making the cans W0 through W8 move smoothly on the article mount surface 18 (the guide grooves 18*a* are not shown in FIGS. 1 through 3).

The bottom plate 15 is provided at a central part thereof in the leftward/rightward direction with a guide plate 19 elongated in the forward/rearward direction. The interior of the article display tray 10 is partitioned into the following chambers: a left-side storage chamber CL positioned on the left-hand side of the guide plate 19; a right-side storage chamber CR positioned on the right-hand side of the guide plate 19; a front-end communication portion CA which communicatively connects the front end portions of the left-side storage chamber CL and the right-side storage chamber CR to each other in front of the guide plate 19; and a rear-end communication portion CB which communicatively connects the rear end portions of the left-side storage chamber CL and the right-side storage chamber CR to each other in the rear of the guide plate 19. The left-side storage chamber CL and the right-side storage chamber CR are mutually identical in width (size in the leftward/rightward direction), and the width is substantially identical to (slightly greater than) the width of each can W0 through W8.

Next, the structure of the movement guide device 20 that is detachably attached to the article display tray 10 will be discussed hereinafter. The movement guide device 20 is provided with a base member 21 and a rocking member 22. The size of the base member 21 in the leftward/rightward direction is identical to the face-to-face size (size in the leftward/rightward direction) between the inner surfaces of the left-side plate 12 and the right-side plate 13, and the front surface of the base member 21 is formed as a guide surface 23 having the shape of a substantially circular arc. In addition, the base plate 21 is provided, on a top surface thereof along the guide surface 23, with an engaging projection 24 having a substantially circular arc shape. The curvature of the rear surface of the engaging projection 24 is identical to the curvature of the front surface of the rear top plate 16. The rocking member 22 that is substantially circular arc in shape is positioned immediately below the base member 21, and a rocking shaft 25 which extends through the base member 21 (the engaging projection 24) in the vertical direction rotatably supports a central portion of the rocking member 22. The member designated by the reference numeral 26 is a washer which prevents the rocking member 22 from coming off below the rocking shaft 25. The top surface of the rocking member 22 is in contact with the lower surface of the base member 21 in a rotatable manner. The front surface of the rocking member 22 serves as a substantially circular-arc-shaped arraying guide surface 27, the left end surface of the rocking member 22 serves as a pressed surface (force-applied portion) 28 made of a curved surface, and the right end surface of the rocking member 22 serves as a pressing surface 29 (force-applied portion) made of a curved surface.

The movement guide device 20 that has the above described structure is installed into an inner surface of the article display tray 10 after being inserted into the rear end portion of the inside of the article display tray 10 from the top opening thereof. To be more precise, the movement guide device 20 is installed into the article display tray 10 with the top surface of the base portion 21 (except the engaging projection 24) being in contact with the lower surface of the rear top plate 16, the entire rear surface of the engaging projection 24 being in contact with the entire front surface of the rear top surface 16, and the rear surface of the base member 21 being in contact with a front surface of the rear plate 14. Since the size of the base member 21 in the leftward/rightward direction and the face-to-face size between the inner surfaces of the left-side plate 12 and the right-side plate 13 are mutually identical (since the left and right side surfaces of the base member 21 are in press contact with inner surfaces of the left-side plate 12 and the right-side plate 13), the movement guide device 20 does not move relative to the article display tray 10 unless moved intentionally.

Figure 1:
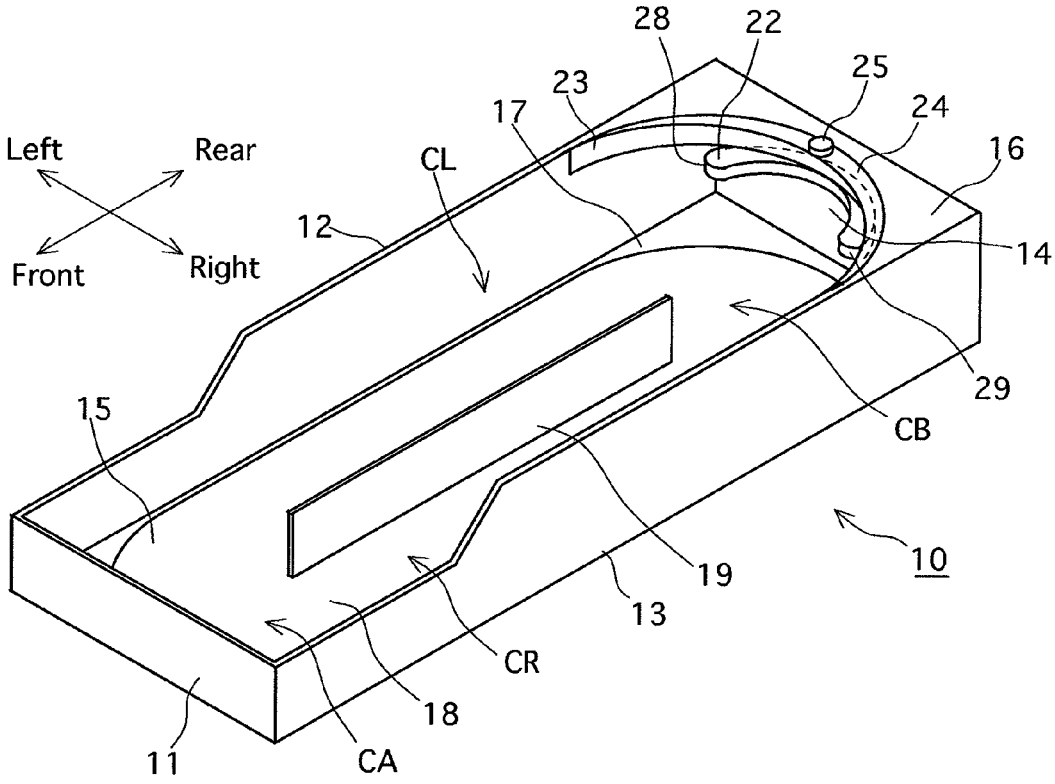
FIG. 1 is a perspective view of a first embodiment of an article display tray, viewed from the front thereof.
Figure 2:
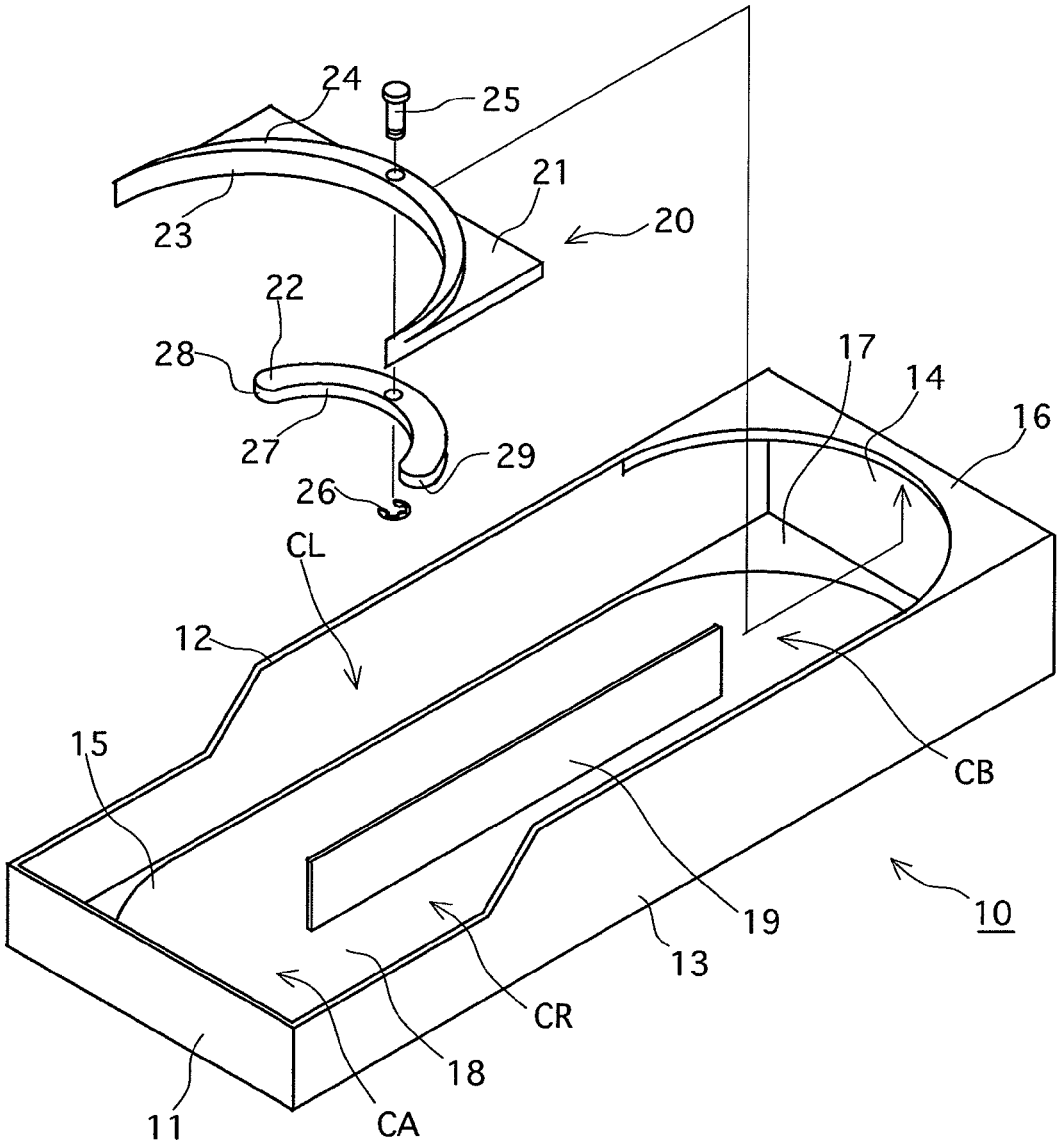
FIG. 2 is an exploded perspective view of the article display tray and a movement guide device, viewed from the front thereof.
Figure 3:
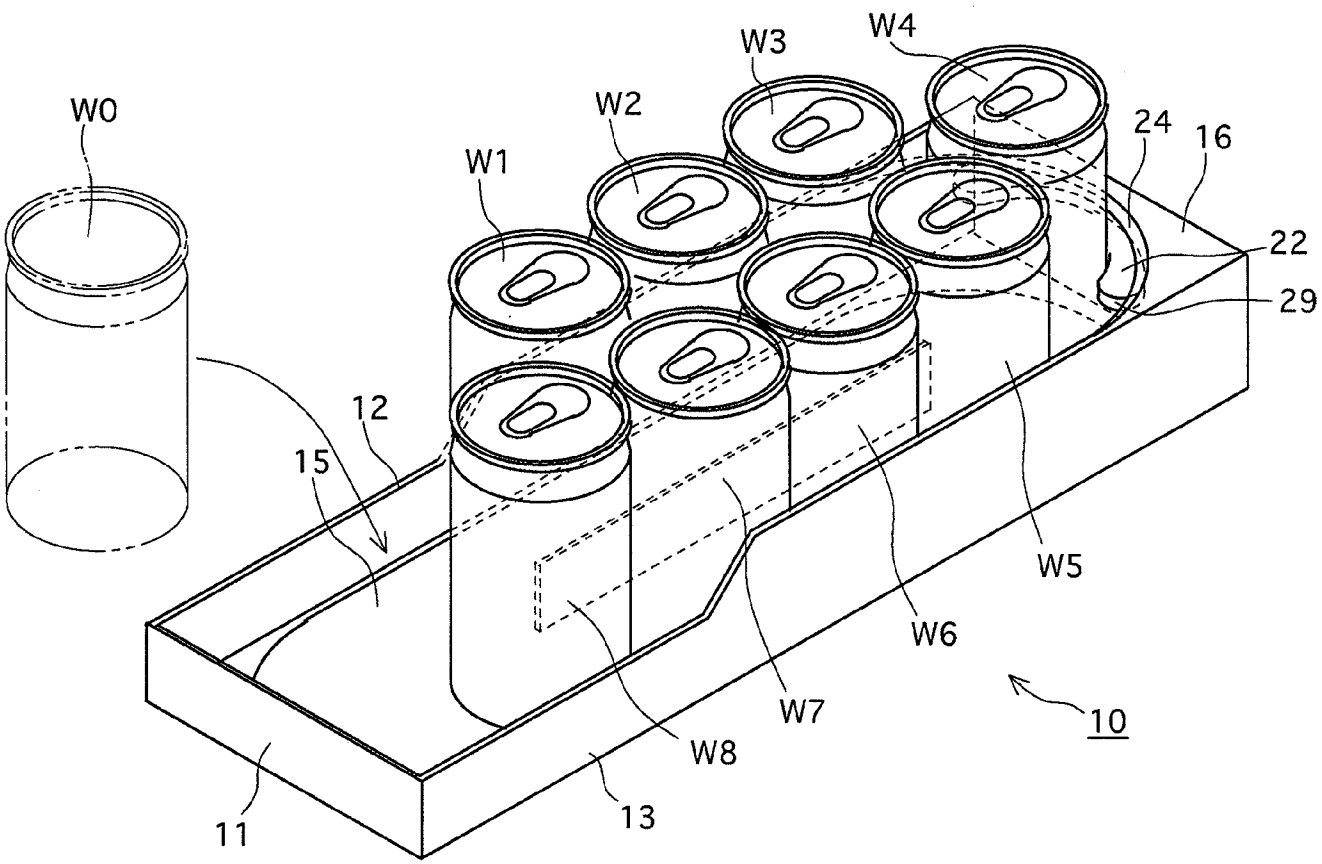
FIG. 3 is a perspective view showing a state where cans are displayed on the article display tray.
Figure 4:
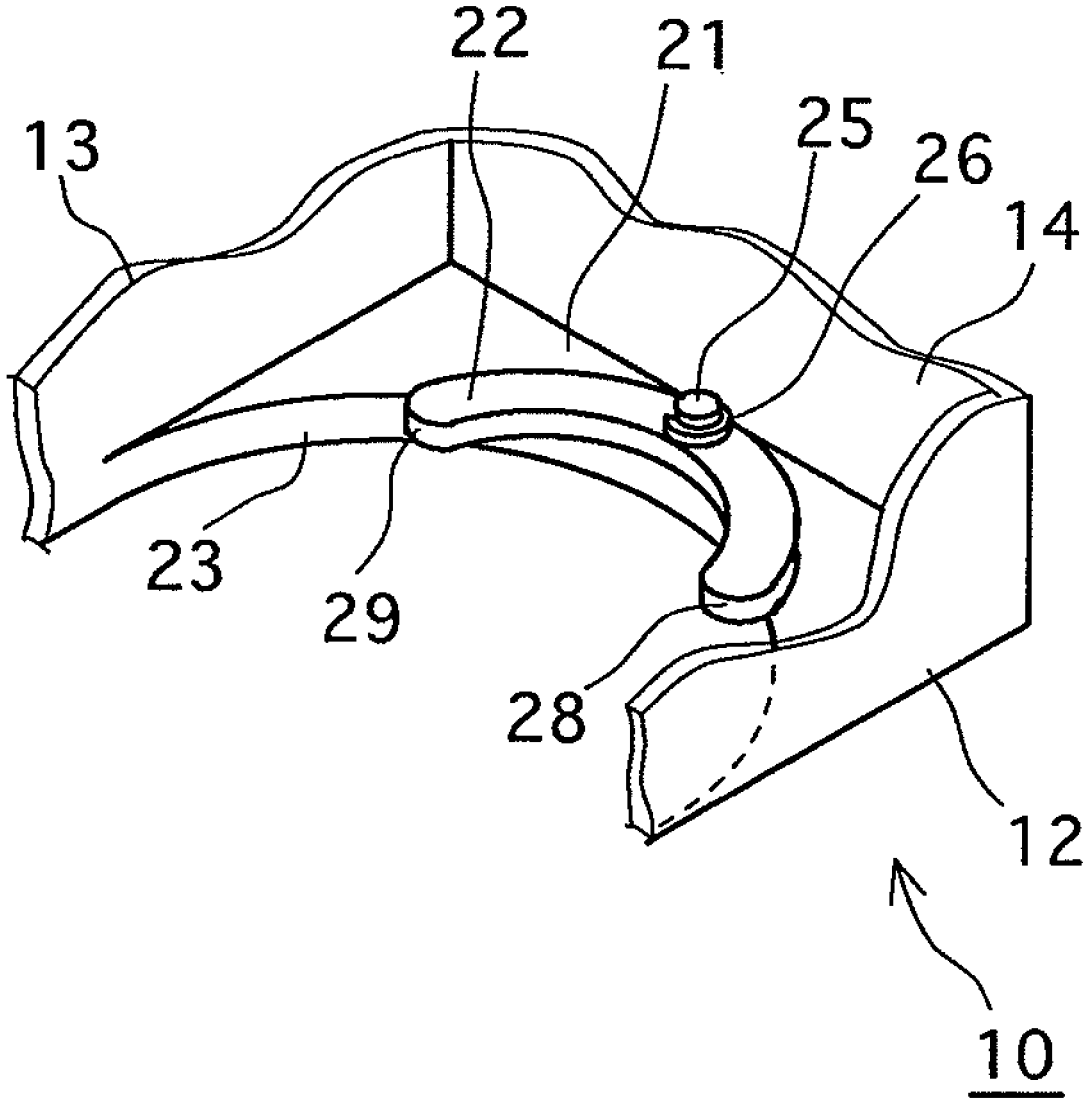
FIG. 4 is a perspective view of a rear end portion of the article display tray and the movement guide device, viewed from below.

Next, the operation of the article display tray 10 equipped with the movement guide device 20 will be discussed hereinafter. A total of 10 cans, i.e., the cans W0 through W8 can be arranged and placed on the article mount surface 18 of the article display tray 10. FIG. 3 shows a state where eight cans W1 through W8 of the same type are placed on the article display tray 18, wherein the eight cans W1 through W8 are mutually identical in date of manufacture and best-before date. In this state, three cans (the cans W1, W2 and W3) are displayed with being arranged in the forward/rearward direction in the left-side storage chamber CL, four cans (the cans W5, W6, W7 and W8) are displayed while being arranged in the forward/rearward direction in the right-side storage chamber CR (wherein the cans W1 and W7 are aligned in the leftward/rightward direction, the cans W2 and W6 are aligned in the leftward/rightward direction, and the cans W3 and W5 are aligned in the leftward/rightward direction), and one can (the can W4) is displayed in the central part of the rear-end communication portion CB. It is possible for a can and another can to be further displayed at the front end of the left-side storage chamber CL and the center of the front-end communication portion CA, respectively.

In this manner, since no cans are displayed at the front end portion of the left-side storage chamber CL in the state shown in FIG. 3, a new can (the can W0) which is newer (newer date of manufacture and later best-before date) than any of the cans W1 through W8 can be displayed in this front end portion. If the can W0 that is newer than the other cans W1 through W8 is displayed at the front end portion of the left-side storage chamber CL in this manner, the can W0 will be positioned at the front-end side, i.e., the state known as "first in, last out" (FILO) will occur. Therefore, the can W0 needs to be moved to the inner rear of the article display tray 10 (i.e., to the rear-end communication portion CB).

In order to move the can W0 to the rear-end communication portion CB, the can W0 which is placed at the front end portion of the left-side storage chamber CL and is pushed rearward. Thereupon, the can W0 presses the can W1 positioned immediately behind the can W0; furthermore, the can W1 presses the can W2 rearward, and the can W2 presses the can W3 rearward. At the time immediately before the can W0 is pressed rearward, the rear end surface of the can W4 positioned in the rear-end communication portion CB is in contact with a central portion of the arraying guide surface 27 of the rocking member 22 (at this time, the pressed surface 28 and the pressing surface 29 of the rocking member 22 are in a neutral position where the pressed surface 28 and the pressing surface 29 are aligned in the leftward/rightward direction), and the cans W3 and W5 are aligned in the leftward/rightward direction. At this time, if the movement guide device 20 does not exit, it has been empirically known in the art that the force for moving the can W4 rightward is not easily transmitted from the can W3 to the can W4, and accordingly the movement of each can W0 through W8 becomes unsmooth. However, in the present embodiment equipped with the movement guide device 20, if the can W3 presses the can W4 along with the rearward pushing operation of the can W0, the can W4 moves rightward along the guide surface 23 while rotating the rocking member 22 counterclockwise with respect to FIG. 7, and the can W4 comes into contact with the pressing surface 29 of the rocking member 22 before long; furthermore, the can W3 comes in contact with the pressed surface 28 of the rocking member 22 (see FIG. 8). If the can W3 further moves rearward, the can W3 presses the pressed surface 28 of the rocking member 22 rearward while moving along the guide surface 23, and therefore, the rocking member 22 rotates clockwise with respect to FIG. 8. Thereupon, along with this movement the pressing surface 29 of the rocking member 22 pushes the can W4 forward, so that in a short time the pressed surface 28 and the pressing surface 29 of the rocking member 22 are aligned in the leftward/rightward direction while the cans W3 and W4 are aligned in the leftward/rightward direction (see FIG. 9). From this state if the can W3 further moves rearward, the can W3 further presses the pressed surface 28 of the rocking member 22 rearward while moving along the guide surface 23, and therefore, the rocking member 22 rotates clockwise, which causes the pressing surface 29 of the rocking member 22 to further push the can W4 forward (see FIG. 10). Subsequently, upon the can W0 moving rearward by an amount of one can (upon the can W0 moving to the position where the can W1 is positioned in FIG. 3), the rear end surface of the can W3 having moved along the guide surface 23 comes into contact with a central portion of the arraying guide surface 27, and therefore, the pressed surface 28 and the pressing surface 29 of the rocking member 22 are again aligned in the leftward/rightward direction (the rocking member 22 is positioned in the neutral position) while the cans W2 and W4 are aligned in the leftward/rightward direction (see FIG. 11).

If the can W4 moves by an amount of one can in this manner, each of the cans W5 through W8 moves forward by an amount of one can (the can W8 moves to the center of the front-end communication portion CA) because the cans W5, W6, W7 and W8 are pushed forward by the can immediately therebehind.

After the position of each can W0 through W8 moves by an amount of one can clockwise in this manner, the can W8 having moved to the center of the front-end communication portion CA is moved to the front end portion of the left-side storage chamber CL (to bring the can W8 into contact with the W0); in addition, the can W8 is moved rearward by an amount of one can. Thereupon, each can further moves clockwise by an amount of one can. Therefore, if the cans W0 through 8 are made to move by an amount of four cans in such a procedure, the can W0 that is newer than the other cans can be made to move to the rear-end communication portion CB (to the position of the can W4 shown in FIG. 7).

As described above, if the movement guide device 20 is installed onto the article display tray 10, the FIFO (first in, first out) state can be easily achieved because each cylindrical article (can) placed on the article mount surface 18 can be smoothly moved (circulated).

Moreover, the space in the article display tray 10 for the installation of the movement guide device 20 into the article display tray 10 can be extremely small because the movement guide device 20 of the present embodiment does not rotate by a 360-degree rotation, and only rocks clockwise and counter-clockwise about the rocking shaft 25 within a narrow range of rotation. Therefore, the installation of the movement guide device 20 does not cause an increase in width (size in the leftward/rightward direction) of the rear end portion of the article display tray 10 (portion of the article display tray 10 for the installation of the movement guide device 20) (there is no difference in width between the rear end portion and the front portion of the article display tray 10). Furthermore, as compared with the rear end portion of the article display tray which is designed based on the premise that the movement guide device 20 is not installed into the article display tray, an increase in the length of the rear end portion of the article display tray 10 in the forward/rearward direction can be reduced to a minimum.

In addition, the rotational contacting operations of the pressed surface 28 and the pressing surface 29 with the cans W0 through W8 are carried out smoothly because each of the pressed surface 28 and the pressing surface 29 is formed as a curved surface. Therefore, the rocking operation of the rocking member 22 does not become unsmooth.

In addition, each guide groove 18*a* that is formed on the article mount surface 18 shows the capability of guiding the cans W0 through W8 along each guide groove 18*a*. Additionally, the formation of the guide grooves 18*a* on the article mount surface 18 achieves a reduction in the frictional resistance between each can and the article mount surface 18 compared to the case where the article mount surface 18 is formed as a mere flat surface (surface without the guide grooves 18*a*). Accordingly, each can W0 through W8 is movable on the article display tray 18 in an extremely smooth manner.

Moreover, although each can is moved (circulated) clockwise in plan view in the present embodiment, it is a matter of course that each can is movable (can circulate) in a counter-clockwise direction in plan view. In this case, the right end surface 29 of the rocking member 22 becomes a pressed surface which is pressed by a can, and the left end surface 28 of the rocking member 22 serves as a pressing surface which pushes a can.

Next, the second embodiment will be hereinafter discussed with reference to FIGS. 12 through 24 (the forward/rearward direction and the leftward/rightward direction in the following descriptions shall be based on the directions shown by the arrows shown in FIG. 12). Elements similar to those of the first embodiment are designated by the same reference numerals and will not be discussed in detail in the following descriptions.

An article display tray 30 is also provided with a front plate 11, a left-side plate 12, a right-side plate 13, a rear plate 14, a bottom plate 15 (article mount surface 18), a rear top plate 16, a gap 17 and a guide plate 19. However, the article display tray 30 is provided with a structure for connecting the article display tray 30 to the same type of article display tray 30 in the leftward/rightward direction. Specifically, a bottomed engaging groove 31 and a bottomed engaging groove 32 are formed in the right-side plate 13 at front and rear end portions thereof, respectively. Additionally, an engaging recessed portion 33 which is recessed as compared with a rear portion of the right-side plate 13 is formed in a central portion of the right-side plate 13 in the forward/rearward direction. On the other hand, an engaging projection 35 and an engaging projection 36 which are shaped to correspond to the shapes of the bottomed engaging groove 31 and the bottomed engaging groove 32, respectively, are formed on the left-side plate 12 to project therefrom, and an engaging projection 37 which corresponds to the engaging recessed portion 33 is formed on the left-side plate 12.

Figure 13:
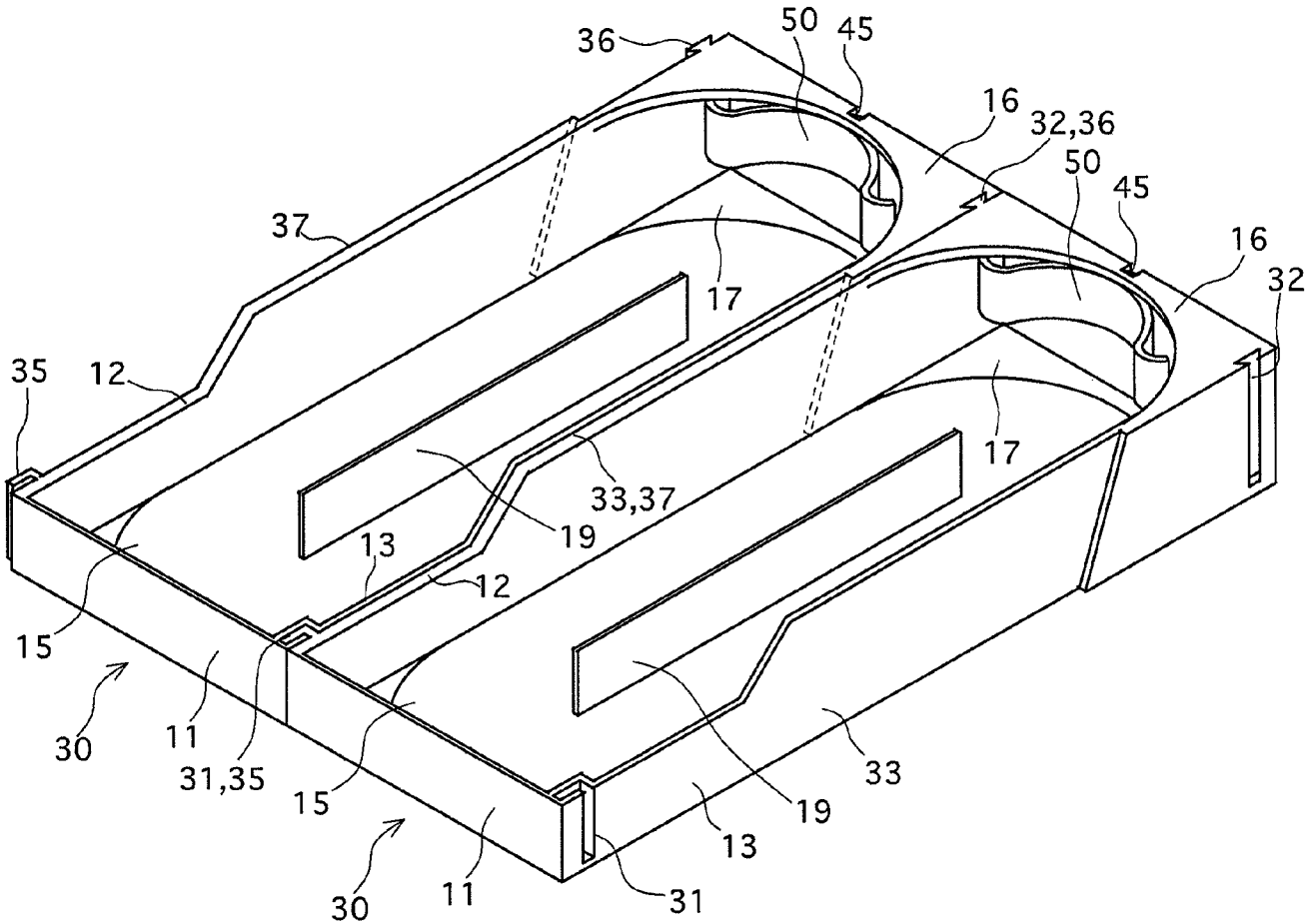
FIG. 13 is an exploded perspective view showing a state where two article display trays are connected to each other, viewed from the front thereof.
Figure 14:
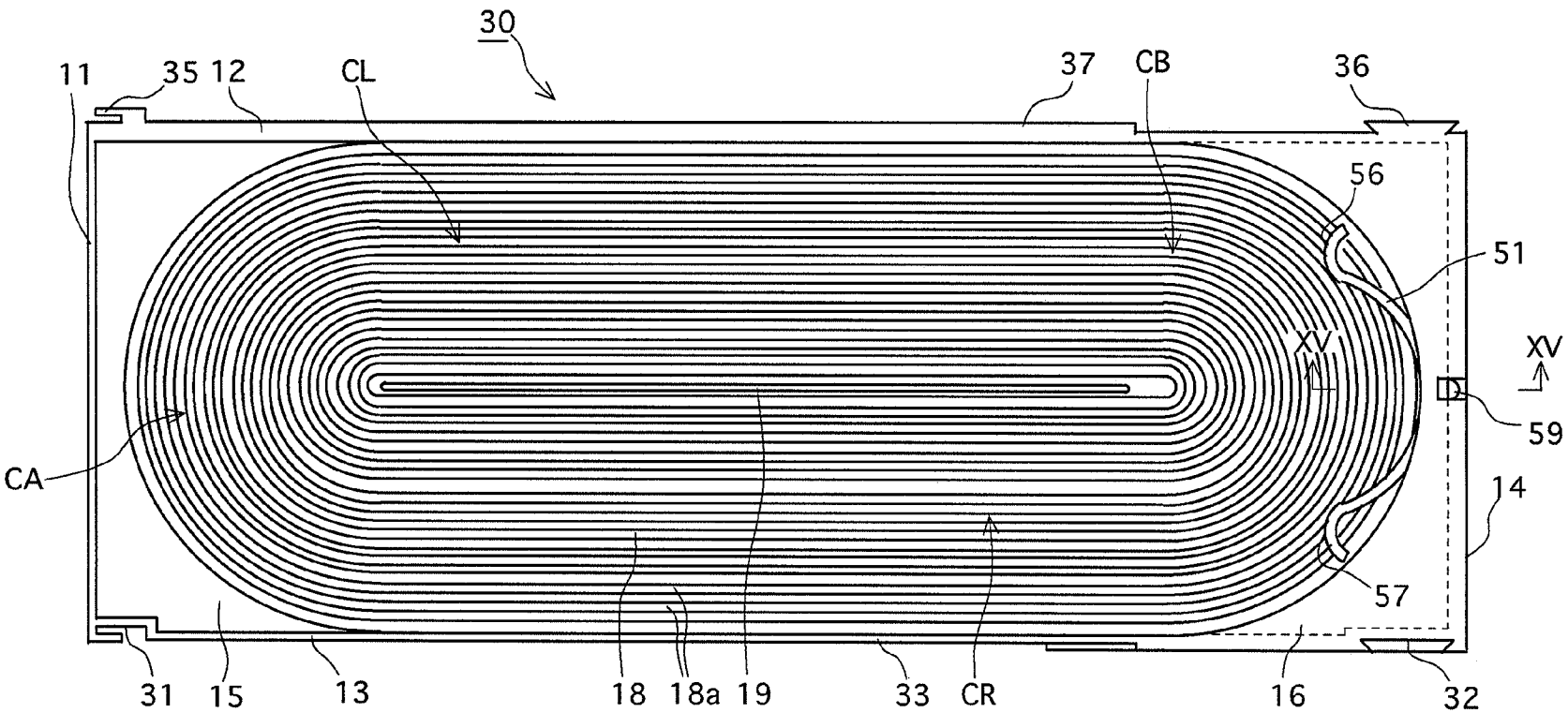
FIG. 14 is a plan view of the article display tray and the movement guide device.

Therefore, as shown in FIG. 13, the two article display trays 30 can be engaged with each other with the top surfaces of the two article display trays 30 being flush with each other if the engaging projections 35 and 36 of the article display tray 30 on the right-hand side are brought into engagement with the engaging grooves 31 and 32 of the article display tray 30 on the left-hand side from above, respectively. Furthermore, it is possible to engage three or more article display trays 30 in the left-right direction in the same manner. In addition, by moving the article display tray 30 on the right-hand side upward, the article display tray 30 on the right-hand side can be easily removed from the article display tray 30 on the left-hand side.

Additionally, the rear plate 14 is provided, on an upper half of a central portion of the front surface of the rear plate 14, with a bilaterally-symmetrical pair of retainer plates 40 and 41, each of which is in the shape of a circular arc in cross section. As shown in the drawings, the vertical size of the retainer plates 40 and 41 are smaller than a half of the vertical size of the rear plate 14. Additionally, the rear plate 14 is provided, on a front surface thereof between the retainer plates 40 and 41, with a central projection 42 in the shape of a triangular prism, wherein a contacting line (ridge line) 43 of the central projection 42 that is the front end thereof lies in a plane in which the front surface of the rear plate 14 lies. In addition, an engaging hole 45 is formed at the corner between the rear plate 14 and the rear top plate 16 in the center of the corner in the leftward/rightward direction.

The movement guide device 50 of the second embodiment is provided with a rocking member 51 which is in a shape of a substantially circular arc in plan view, a connecting portion 52 which projects from a central portion of the rear surface of the rocking member 51, and a pivot portion (rocking shaft) 53 in the shape of a half-column which is connected to the rear end of the connecting portion 52. The vertical size of the pivot portion 53 is smaller than the portion between the bottom end surfaces of the retainer plates 40 and 41 and the bottom plate 15. An arraying guide surface 55 is formed on the front surface of the rocking member 51, and the left end surface and the right end surface of the rocking member 51 are formed as a pressed surface (force-applied portion) 56 and a pressing surface (force-applied portion) 57, respectively, each of which is shaped into a curved surface. Additionally, an engaging projection 59 in the shape of a halved circular cone is formed to project from an upper end portion of the rear surface of the pivot portion 53.

Figure 12:
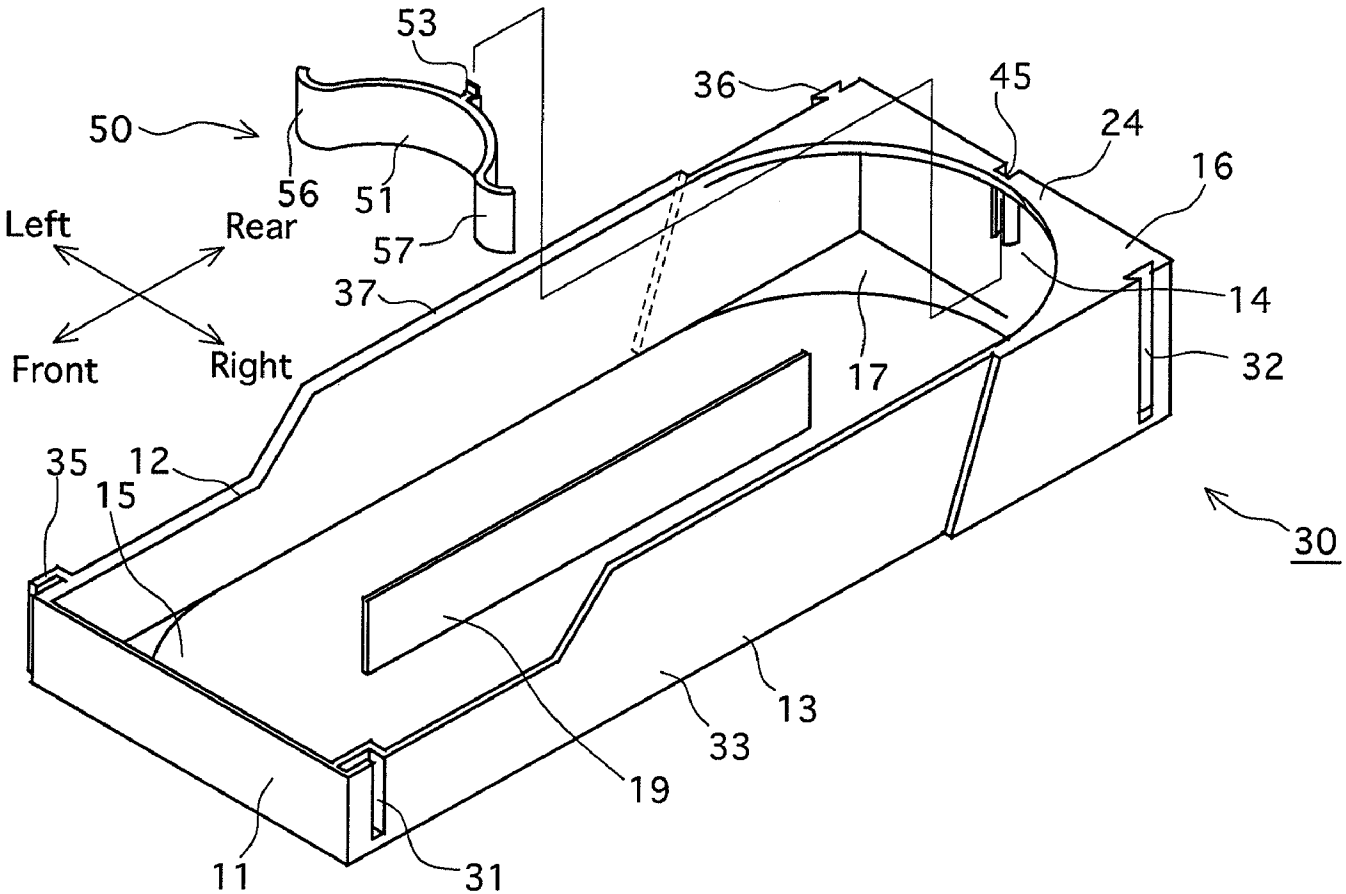
FIG. 12 is an exploded perspective view of a second embodiment of the article display tray and the movement guide device, viewed from the front thereof.
Figure 15:
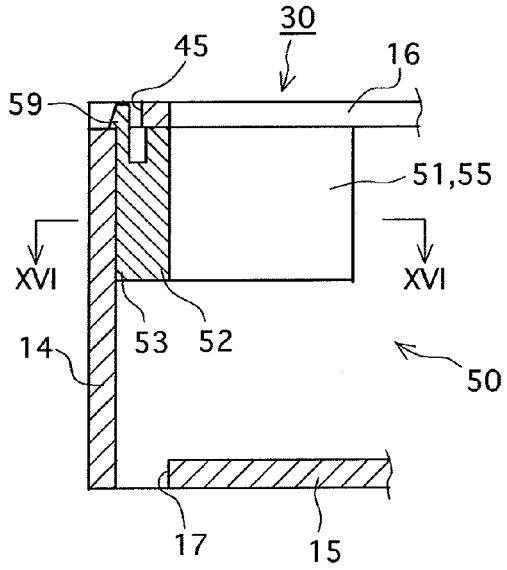
FIG. 15 is a cross sectional view taken along the XV-XV line shown in FIG. 14.
Figure 16:
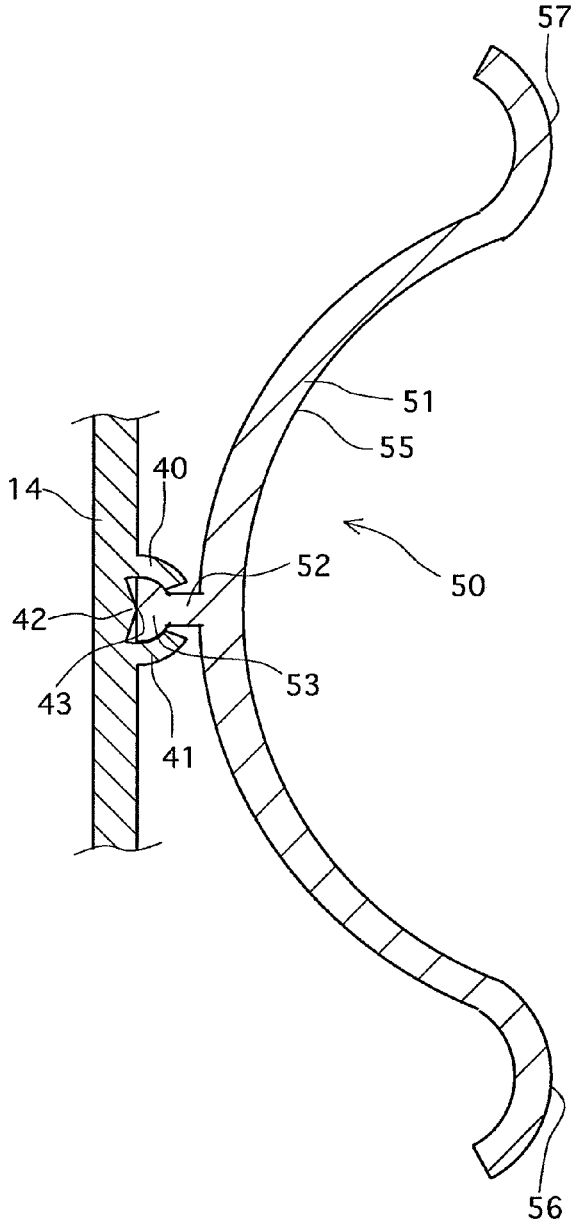
FIG. 16 is a cross sectional view taken along the XVI-XVI line shown in FIG. 15.
Figure 17:
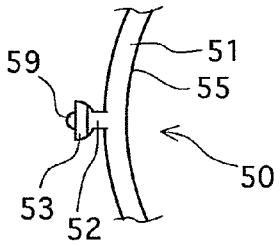
FIG. 17 is a plan view of a central portion of the movement guide device.
Figure 18:
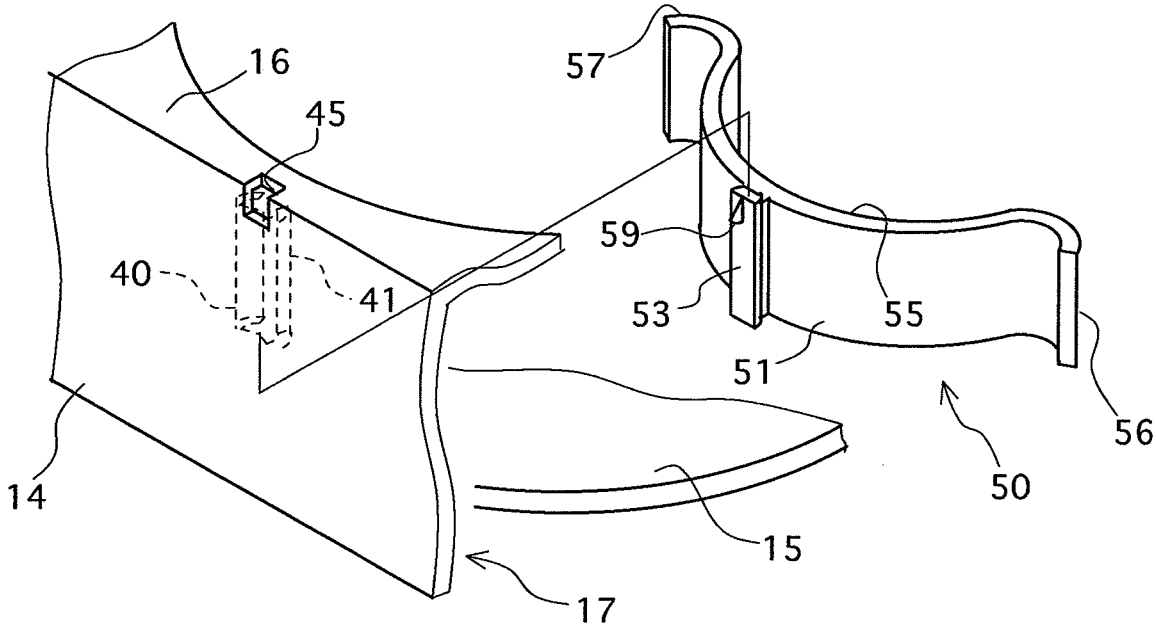
FIG. 18 is an exploded perspective view of a rear end portion of the article display tray and the movement guide device, viewed from the rear thereof.
Figure 19:
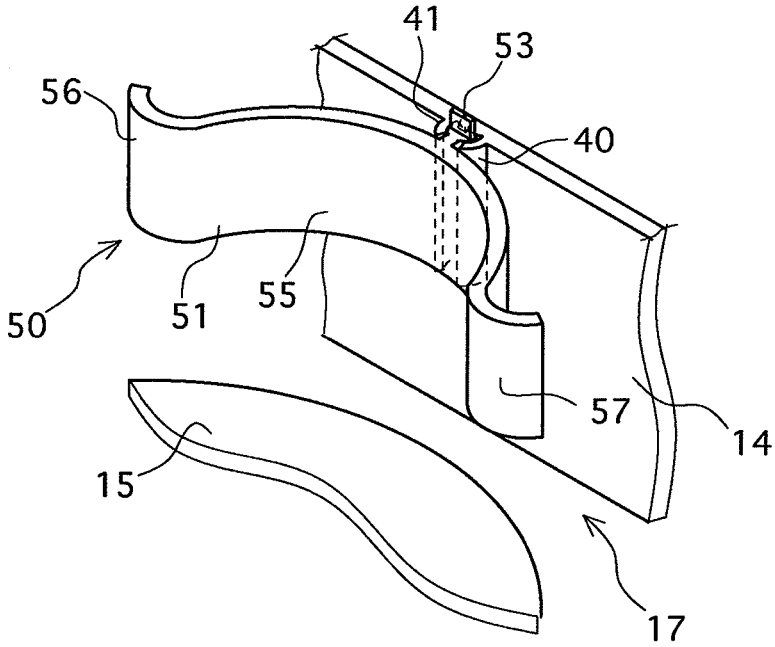
FIG. 19 is an exploded perspective view of the rear end portion of the article display tray and the movement guide device, viewed from the front thereof.

As shown in FIGS. 12, 18 and 19, the movement guide device 50 is inserted into the article display tray 30 from the top opening thereof. Subsequently, the movement guide device 50 is installed in the article display tray 30 by inserting the pivot portion 53 into the space surrounded by the retainer plates 40 and 41 and the central projection 42 (the contacting line 43) from below the retainer plates 40 and 41 and bringing the lower surface of the engaging projection 59 into contact with the bottom surface in the engaging hole 45. If the movement guide device 50 is installed in the rear end portion of the article display tray 30 in this manner, the peripheral surface of the pivot portion 53 comes in contact with inner surfaces of the retainer plates 40 and 41 as shown in FIG. 16 while the rear surface of the pivot portion 53 comes in line contact with the contacting line 43 of the central projection 42, and therefore, the movement guide device 50 can rock in the leftward/rightward direction within a range of movement at the opposite ends of which the flat rear surface of the pivot portion 53 comes into contact with left and right surface portions of the central projection 42 on the opposite sides of the contacting line 43, respectively. Additionally, since the lower surface of the engaging projection 59 is elastically engaged with the bottom surface in the engaging hole 45 as shown in FIG. 15, the movement guide device 50 does not fall off the article display tray 30 accidentally unless the engagement of the engaging projection 59 and the engaging hole 45 is intentionally released.

Figure 7:
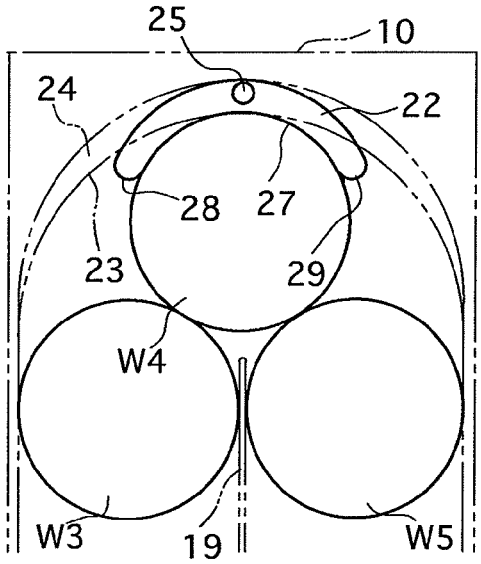
FIG. 7 is a plan view of the rear end portion of the article display tray and the movement guide device to illustrate the operation of the movement guide device.
Figure 8:
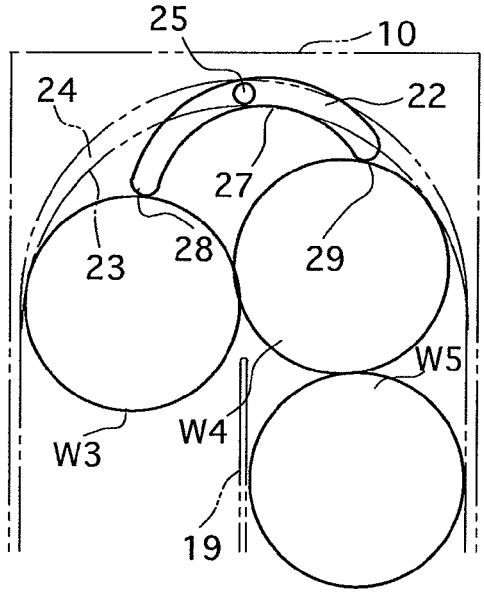
FIG. 8 is a plan view similar to that of FIG. 7, showing a state when each can has moved clockwise in plan view from the state shown in FIG. 7.
Figure 9:
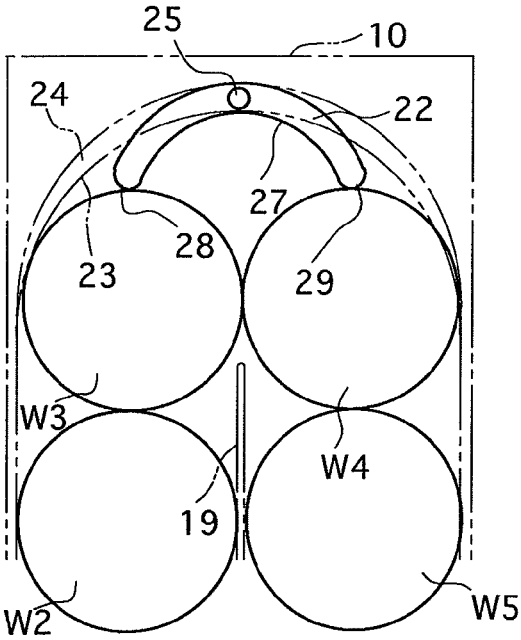
FIG. 9 is a plan view similar to that of FIG. 7, showing a state when each can has further moved clockwise in plan view from the state shown in FIG. 8.
Figure 10:
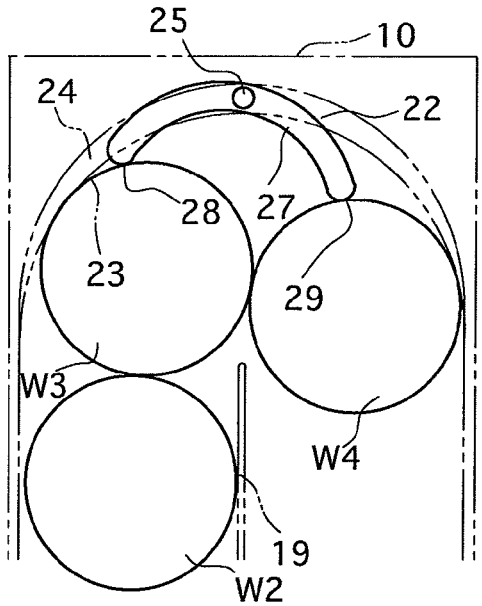
FIG. 10 is a plan view similar to that of FIG. 7, showing a state when each can has further moved clockwise in plan view from the state shown in FIG. 9.
Figure 11:
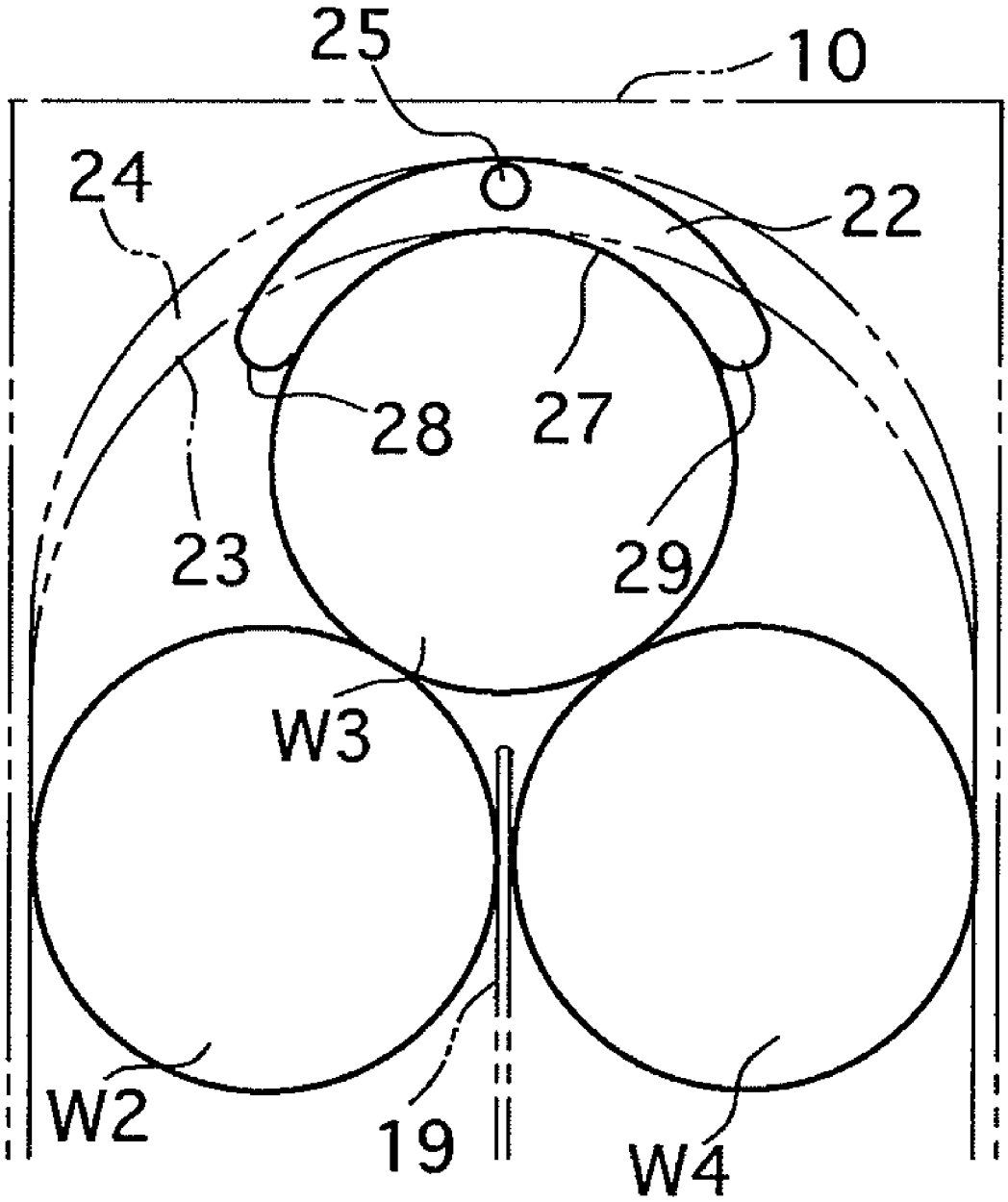
FIG. 11 is a plan view similar to that of FIG. 7, showing a state when each can has moved clockwise in plan view by an amount of one can from the state shown in FIG. 7.
Figure 20:
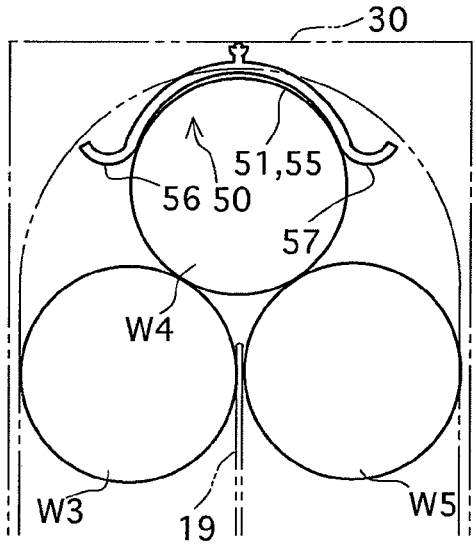
FIG. 20 is a plan view of the rear end portion of the article display tray and the movement guide device to illustrate the operation of the movement guide device.
Figure 21:
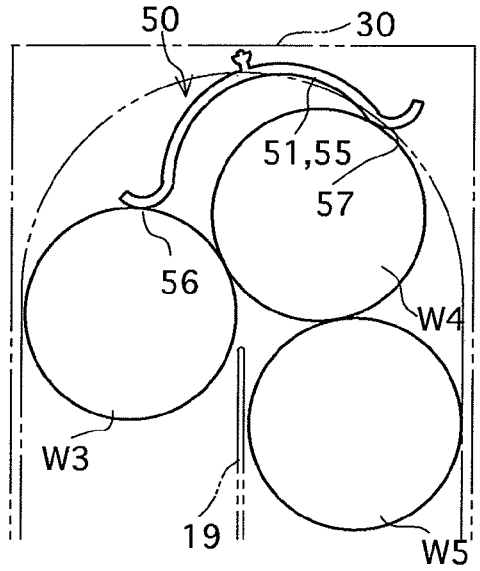
FIG. 21 is a plan view similar to that of FIG. 20, showing a state when each can has moved clockwise in plan view from the state shown in FIG. 20.
Figure 22:
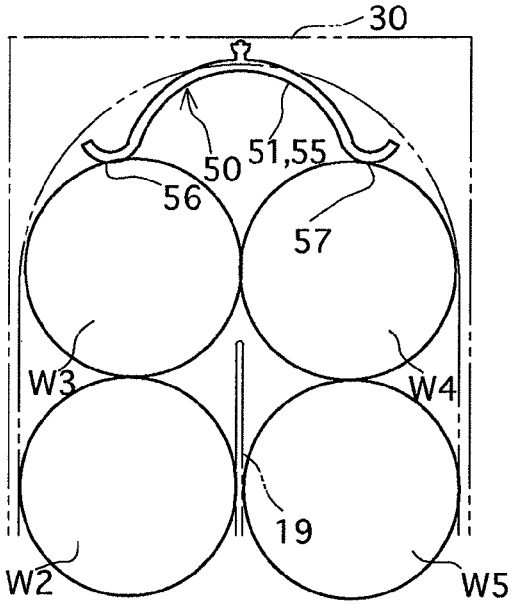
FIG. 22 is a plan view similar to that of FIG. 20, showing a state when each can has further moved clockwise in plan view from the state shown in FIG. 21.
Figure 23:
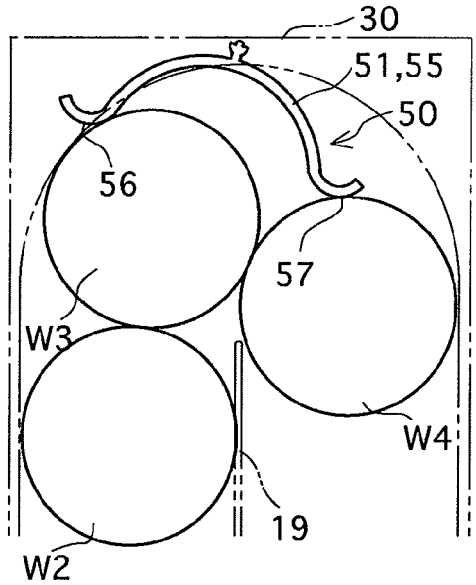
FIG. 23 is a plan view similar to that of FIG. 20, showing a state when each can has further moved clockwise in plan view from the state shown in FIG. 22.
Figure 24:
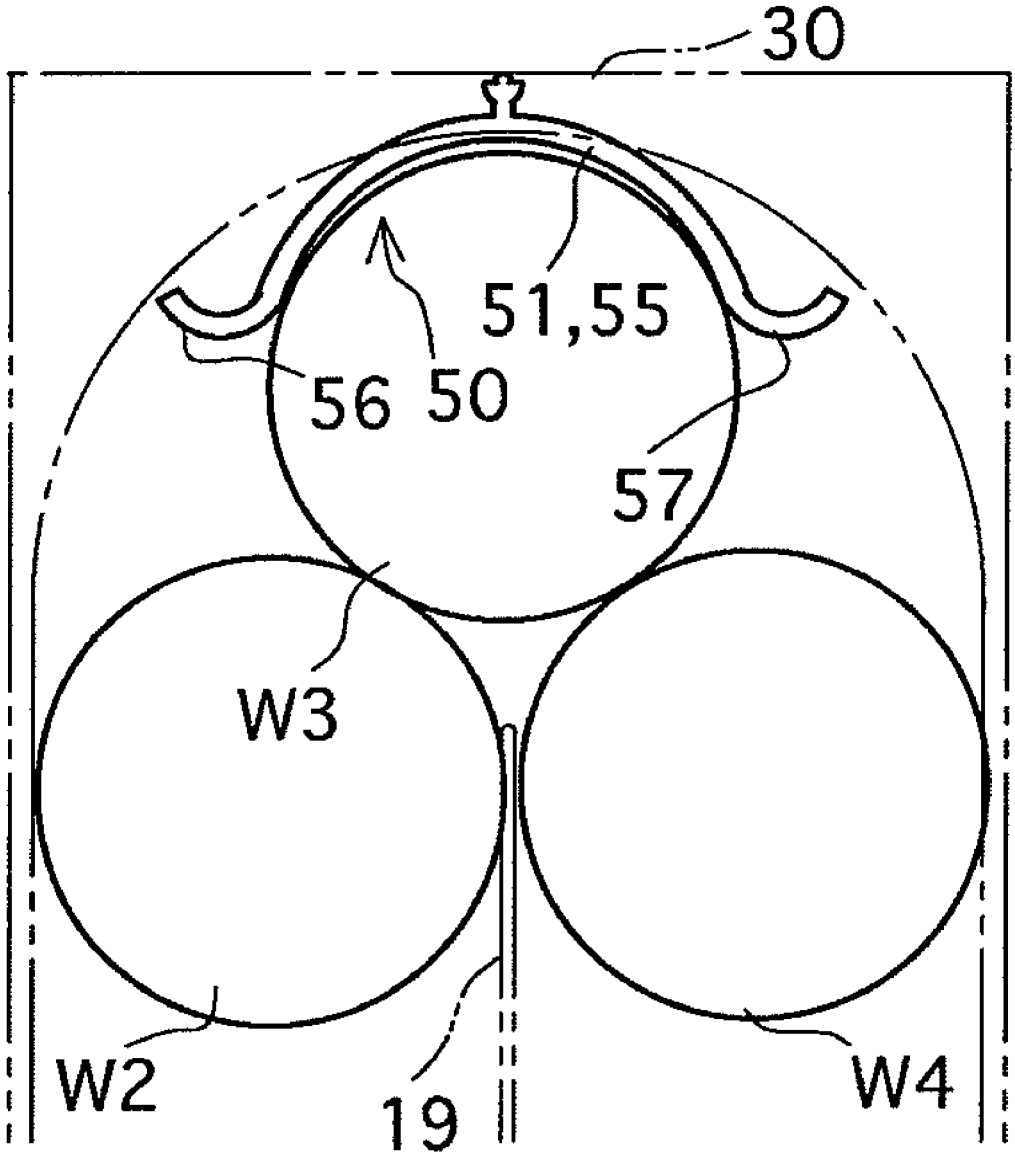
FIG. 24 is a plan view similar to that of FIG. 20, showing a state when each can has moved clockwise in plan view by an amount of one can from the state shown in FIG. 20.

In the second embodiment with the above described structure, in a state where the pressed surface 56 and the pressing surface 57 are aligned in the leftward/rightward direction while the can W4 is in contact with the arraying guide surface 55 (i.e., a state corresponding to the state of the first embodiment shown in FIGS. 3 and 7), if the can W0 (not shown in FIGS. 12 through 24) which is placed in the front end portion of the left-side storage chamber CL is pushed rearward, the can W4 moves diagonally forward right along the substantially circular-arc-shaped front surface (guide surface) of the rear top plate 16 while rotating the movement guide device 50 counterclockwise with respect to FIG. 20 and comes into contact with the pressing surface 57, which brings the cans and the movement guide device 50 into a state shown in FIG. 21 (which corresponds to the state shown in FIG. 8 in the first embodiment) where the can W3 is in contact with the pressed surface 56. If the can W0 is further pushed rearward, the can W3 moves along the front surface of the rear top plate 16 while remaining in contact with the pressed surface 56, the pressed surface 56 and the pressing surface 57 of the movement guide device 50 are aligned in the leftward/rightward direction, and the cans and the movement guide device 50 come into the state shown in FIG. 22 (which corresponds to the state shown in FIG. 9 in the first embodiment; at this time, the can W3 and the can W4 are aligned in the leftward/rightward direction) where the can W4 is in contact with the pressing surface 57. In addition, if the can W3 pushes against the pressed surface 56 while moving along the front surface of the rear top plate 16, the movement guide device 50 rotates clockwise, and the cans and the movement guide device 50 come into the state shown in FIG. 23 (which corresponds to the state shown in FIG. 10 in the first embodiment) in which the pressing surface 57 pushes the can W4 forward. Thereafter, when the can W0 moves rearward by an amount of one can, the can W3 comes into contact with left and right portions of the arraying guide surface 55 of the movement guide device 50, and accordingly, the cans and the movement guide device 50 come into a state shown in FIG. 24 (which corresponds to the state shown in FIG. 11 in the first embodiment) where the pressed surface 56 and the pressing surface 57 are again aligned in the leftward/rightward direction, and the can W2 and the can W4 are aligned in the leftward/rightward direction.

Accordingly, the can W0 can be moved (circulated) to the rear-end communication portion CB in a similar manner to the first embodiment.

As described above, according to the article display tray 30 and the movement guide device 50 of the second embodiment also, each can placed on the article display tray 18 can be moved (circulated) in a smooth manner.

Additionally, since the space in the article display tray 30 for the installation of the movement guide device 50 in the article display tray 30 is extremely small in the second embodiment also, the installation of the movement guide device 50 does not cause an increase in size of the rear end portion of the article display tray 30 in the leftward/rightward direction. Moreover, an increase in the length of the rear end portion of the article display tray 10 in the forward/rearward direction which is caused by the installation of the movement guide device 50 is extremely small.

In the second embodiment also, each can is movable (can be circulated) counterclockwise. In this case, the right end surface 57 of the rocking member 51 becomes a pressed surface which is pushed by a can, and the left end surface 56 of the rocking member 51 serves as a pressing surface which pushes a can.

Although the present invention has been discussed using the first and second embodiments, the present invention is not limited to these embodiments; these embodiments can be practiced with various changes made.

For instance, the base member 21 of the movable guide device 20 of the first embodiment can be formed integrally with the article display tray 10.

Additionally, it is of course possible to apply the movement guide device 20 of the first embodiment so as to be installed into the article display tray 30 of the second embodiment, and it is of course also possible to apply the movement guide device 50 of the second embodiment so as to be installed into the article display tray 10 of the first embodiment (to which the retainer plate 40, the retainer plate 41, the central projection 42 and the engaging hole 45 are formed).

In addition, regarding the article display tray 10 and the article display tray 30, the front plate 11 can be utilized as an advertisement display surface which displays the name of article(s) or the like.

In addition, not only cans but also bottles or the like can of course be placed on the article display tray 10 or 30 as long as the articles to be placed on the article display tray 10 or 30 are cylindrical articles which are circular in cross section. Additionally, the article display tray 10 and the article display tray 30 can be used not only for being installed to a refrigeration showcase but also in various manners. For instance, the article display tray 10 and the article display tray 30 can be used for displaying various articles such as containers of other foods, or containers of shampoo or hair dressing.

INDUSTRIAL APPLICABILITY

If the present invention is utilized, the FIFO (first in, first out) state can be easily achieved because cylindrical articles such as cans and bottles in the rear-end communication portion that communicatively connects the pair of storage chambers to each other can be smoothly moved.

Moreover, the space in the article display tray for the installation of the movement guide device to the article display tray can be extremely small because the movement guide device of the present embodiment does not rotate by a 360-degree rotation about a rocking shaft and only rocks clockwise and counterclockwise within a narrow range of rotation.

The present invention like this is useful for an article display tray provided with a movement guide device, and a movement guide device; the present invention can contribute greatly to an expansion of industry by being used for the industry associated with such an article display tray and such a movement guide device.

The invention claimed is:

1. An article display tray provided with a movement guide device, comprising:

an article display tray including a pair of left-right storage chambers and a rear-end communication portion which communicatively connects rear end portions of said pair of left-right storage chambers to each other, cylindrical articles that are circular in cross section being movable between said pair of left-right storage chambers through said rear-end communication portion; and a base member mounted on said rear-end communication portion, said base member including an arc shaped front portion facing said storage chambers, a rocking member positioned inside said rear-end communication portion of said article display tray and capable of rocking about a rocking shaft extending in a vertical direction, said rocking member having an arc shape surface facing said storage chambers, the rocking shaft extending through said base member and a central portion of said rocking member, said rocking shaft rotatably supporting said rocking member, wherein said rocking member includes a pair of force-applied portions which are positioned at left and right ends of said rocking member on imaginary extension lines of said pair of left-right storage chambers, respectively, and an arraying guide surface positioned between said pair of force-applied portions, wherein, when one of said pair of force-applied portions is pushed rearward by one of said cylindrical articles which is placed in one of said pair of left-right storage chambers, and the other of said pair of force-applied portions pushes another of said cylindrical articles forward which is placed in the other of said pair of left-right storage chambers, and wherein, upon said one of said cylindrical articles pushing said one of said force-applied portions rearward so as to come into engagement with said arraying guide surface, said arraying guide surface returns said rocking member to a neutral position where said pair of left-right storage chambers are aligned in a leftward/rightward direction.

2. The article display tray provided with said movement guide device according to claim 1, wherein said article display tray or said movement guide device comprises a guide surface for moving one of said cylindrical articles which engages with said arraying guide surface to a position immediately before said one of said force-applied portions which is positioned ahead of said one of said cylindrical articles in a direction of movement thereof when said one of said cylindrical articles that engages with said arraying guide surface is pushed rearward by one of said cylindrical articles which is positioned at the rear end portion of said one of said pair of storage chambers.

3. The article display tray provided with said movement guide device according to claim 1, wherein at least one of said pair of force-applied portions is a curved surface.

4. The article display tray provided with said movement guide device according to claim 1, wherein guide grooves narrower in width than diameters of said cylindrical articles are formed on an article mount surface of said article display tray along a direction of movement of said cylindrical articles, said article mount surface supporting bottom surfaces of said cylindrical articles placed in said pair of storage chambers.

5. A movement guide device which is installed at a rear-end communication portion of an article display tray, wherein said article display tray includes a pair of left-right storage chambers and said rear-end communication portion which communicatively connects rear end portions of said pair of left-right storage chambers to each other, cylindrical articles that are circular in cross section being movable between said pair of left-right storage chambers through said rear-end communication portion, wherein said movement guide device comprises:

a base member mounted on said rear-end communication portion, said base member including an arc shaped front portion facing said storage chambers, a rocking member capable of rocking about a rocking shaft extending in a vertical direction, said rocking member having an arc shape surface facing said storage chambers, the rocking shaft extending through said base member and a central portion of said rocking member, said rocking shaft rotatably supporting said rocking member;

a pair of force-applied portions provided at left and right ends of said rocking member and positioned on extension lines of said pair of left-right storage chambers, respectively; and an arraying guide surface formed between said pair of force-applied portions, wherein, when one of said pair of force-applied portions is pushed rearward by one of said cylindrical articles which is placed in one of said pair of left-right storage chambers, and the other of said pair of force-applied portions pushes another of said cylindrical articles forward which is placed in the other of said pair of left-right storage chambers, and wherein, upon said one of said cylindrical articles pushing said one of said force-applied portions rearward so as to come into engagement with said arraying guide surface, said arraying guide surface returns said rocking member to a neutral position where said pair of left-right storage chambers are aligned in a leftward/rightward direction.

6. The movement guide device according to claim 5, wherein at least one of said pair of force-applied portions comprises a curved surface.

7. The article display tray provided with said movement guide device according to claim 2, wherein at least one of said pair of force-applied portions is a curved surface.

8. The article display tray provided with said movement guide device according to claim 2, wherein guide grooves narrower in width than diameters of said cylindrical articles are formed on an article mount surface of said article display tray along a direction of movement of said cylindrical articles, said article mount surface supporting bottom surfaces of said cylindrical articles placed in said pair of storage chambers.

9. The article display tray provided with said movement guide device according to claim 3, wherein guide grooves narrower in width than diameters of said cylindrical articles are formed on an article mount surface of said article display tray along a direction of movement of said cylindrical articles, said article mount surface supporting bottom surfaces of said cylindrical articles placed in said pair of storage chambers.

10. The article display tray provided with said movement guide device according to claim 7, wherein guide grooves narrower in width than diameters of said cylindrical articles are formed on an article mount surface of said article display tray along a direction of movement of said cylindrical articles, said article mount surface supporting bottom surfaces of said cylindrical articles placed in said pair of storage chambers.

* * * * *